US011161530B2

(12) United States Patent
Ren et al.

(10) Patent No.: US 11,161,530 B2
(45) Date of Patent: Nov. 2, 2021

(54) TRACTION MECHANISM, BOGIE ASSEMBLY, AND STRADDLE-TYPE MONORAIL VEHICLE

(71) Applicant: BYD COMPANY LIMITED, Guangdong (CN)

(72) Inventors: Lin Ren, Shenzhen (CN); Daolin Li, Shenzhen (CN); Zhicheng Tan, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 370 days.

(21) Appl. No.: 16/335,074

(22) PCT Filed: Feb. 28, 2017

(86) PCT No.: PCT/CN2017/075174
§ 371 (c)(1),
(2) Date: Mar. 20, 2019

(87) PCT Pub. No.: WO2018/054006
PCT Pub. Date: Mar. 29, 2018

(65) Prior Publication Data

US 2019/0276056 A1 Sep. 12, 2019

(30) Foreign Application Priority Data

Sep. 21, 2016 (CN) ..... 201610840624.3

(51) Int. Cl.
*B61F 5/22* (2006.01)
*B61B 13/06* (2006.01)
(Continued)

(52) U.S. Cl.
CPC ..... *B61F 5/22* (2013.01); *B61B 13/04* (2013.01); *B61B 13/06* (2013.01); *B61F 1/14* (2013.01); *B61F 3/00* (2013.01); *B61F 5/48* (2013.01)

(58) Field of Classification Search
CPC ..... B61F 5/22; B61F 1/14; B61F 3/00; B61F 5/48; B61F 5/00; B61F 5/02; B61F 5/16;
(Continued)

(56) References Cited

U.S. PATENT DOCUMENTS 3,017,838 A 1/1962 Bingham
3,048,127 A * 8/1962 Oberpaul ..... B61B 13/04 105/145
(Continued)

FOREIGN PATENT DOCUMENTS

CN 201012687 Y 1/2008
CN 201033572 Y 3/2008
(Continued)

OTHER PUBLICATIONS

PCT International Search Report and the Written Opinion dated Jun. 23, 2017, issued in related International Application No. PCT/CN2017/075174 (11 pages).
(Continued)

*Primary Examiner* — S. Joseph Morano
*Assistant Examiner* — Cheng Lin

(57) ABSTRACT

A traction mechanism, a bogie assembly and a straddle-type monorail vehicle are disclosed. The traction mechanism comprises: a traction component, comprising a transmission shaft and a traction connecting rod, the transmission shaft and the traction connecting rod being connected, the transmission shaft being suitable to be rotatably connected to a vehicle body, and the traction connecting rod being suitable to be hinged to a bogie frame; and a traction crank, both ends
(Continued)

of the traction crank being suitable to be respectively hinged to the bogie frame and the vehicle body. The traction mechanism of the present disclosure has a simple and compact structure, and a transmission path of a traction force is short. The traction mechanism is convenient to assemble and disassemble, occupies a small space, is wide in usage range, can be used for low-floor and high-floor vehicles, and is also applicable to a single-axle bogie, a double-axle bogie and a multi-axle bogie.

16 Claims, 5 Drawing Sheets

(51) Int. Cl.

| | |
|---|---|
| ***B61F 1/14*** | (2006.01) |
| ***B61F 3/00*** | (2006.01) |
| ***B61B 13/04*** | (2006.01) |
| ***B61F 5/48*** | (2006.01) |

(58) Field of Classification Search

CPC ..... B61F 5/24; B61F 5/40; B61F 5/42; B61F 5/52; B61F 3/12; B61F 3/125; B61F 5/245; B61F 5/38; B61F 5/50; B61B 13/04; B61B 13/06

USPC ..... 105/141, 144, 145, 84, 199.1, 199.2

See application file for complete search history.

(56) References Cited

U.S. PATENT DOCUMENTS

| | | | | |
|---|---|---|---|---|
| 3,143,977 | A * | 8/1964 | Konrad | B61B 13/04 105/144 |
| 4,362,109 | A * | 12/1982 | Panagin | B61F 3/02 105/169 |
| 4,953,472 | A * | 9/1990 | Tutzer | B61B 13/06 105/144 |
| 5,570,640 | A * | 11/1996 | Kroesch | B61F 5/24 105/199.1 |
| 2001/0022147 | A1 | 9/2001 | Hara et al. | |
| 2011/0303117 | A1 * | 12/2011 | Timan | B61B 13/04 105/199.2 |
| 2014/0261063 | A1 * | 9/2014 | Roudiere | B61F 5/38 105/168 |

FOREIGN PATENT DOCUMENTS

| | | | |
|---|---|---|---|
| CN | 101195379 | A | 6/2008 |
| CN | 201941804 | U | 8/2011 |
| CN | 102216142 | A | 10/2011 |
| CN | 202669831 | U | 1/2013 |
| CN | 103318218 | A | 9/2013 |
| CN | 103889811 | A | 6/2014 |
| CN | 104554323 | A | 4/2015 |
| CN | 104828107 | A | 8/2015 |
| CN | 105216821 | A | 1/2016 |
| CN | 205239507 | U | 5/2016 |
| JP | 07-149236 | A | 6/1995 |
| KR | 10-1252540 | B1 | 4/2013 |
| WO | 2011044652 | A1 | 4/2011 |
| WO | 2014/107861 | A1 | 7/2014 |

OTHER PUBLICATIONS

Search Report for European Application No. 17852083.9, dated Jul. 31, 2019, 5 pages.
Office Action for Chinese Application No. 201610839645.3, dated Jul. 24, 2017, 7 pages.
Office Action for Chinese Application No. 201610839645.3, dated Oct. 30, 2017, 9 pages.
Office Action for Korea Application No. 10-2019-7008300, dated Feb. 21, 2019, 5 pages.
Office Action for Korea Application No. 10-2019-7008245, dated Feb. 21, 2019, 5 pages.
Office Action for European Application No. 17852085.4, dated Jul. 31, 2019, 4 pages.
Office Action for Chinese Application No. 201610840624.3, dated Jul. 24, 2017, 7 pages.
Office Action for Chinese Application No. 201610840624.3, dated Oct. 30, 2017, 8 pages.
Office Action for Chinese Application No. 201610840624.3, dated Jan. 31, 2018, 4 pages.

* cited by examiner

TRACTION MECHANISM, BOGIE ASSEMBLY, AND STRADDLE-TYPE MONORAIL VEHICLE

CROSS-REFERENCE TO RELATED APPLICATIONS

This application is a national phase application of International Application No. PCT/CN2017/075174, filed on Feb. 28, 2017, which is based on and claims priority to and benefits of Chinese Patent Application No. 201610840624.3, filed with the State Intellectual Property Office (SIPO) of the People's Republic China on Sep. 21, 2016. The entire contents of the above-identified applications are incorporated herein by reference.

TECHNICAL FIELD

The present disclosure belongs to the technical field of vehicle manufacture, and in particular to, a traction mechanism, a bogie assembly having the traction mechanism, and a straddle-type monorail vehicle having the bogie assembly.

BACKGROUND

The cost of laying a straddle-type monorail transit system is much lower than that of a subway transit system, and the straddle-type monorail transit system has a wider range of applications. A traction mechanism between a vehicle body and a bogie frame is an important transmission component of a straddle-type monorail vehicle, and its performance directly affects the safety and ride comfort of the straddle-type monorail vehicle. In the related art, the traction connection between a bogie and the vehicle body is mainly realized by a central traction pin assembly. During the running, the power of a running wheel is transmitted to the bogie frame, and a traction force is transmitted to the vehicle body through the central traction pin assembly. However, the traction mechanism is only applicable to a double-axle bogie, and the pitch motion of the bogie cannot be suppressed. Since the structure is complicated, a large mounting space is occupied, and there is a need for improvement.

SUMMARY

The present disclosure solves one of technical problems in related technologies at least to a certain extent. In view of this, an objective of the present disclosure is to provide a traction mechanism having a wide range of applications.

Another objective of the present disclosure is to provide a bogie assembly having the foregoing traction mechanism.

Yet another objective of the present disclosure is to provide a straddle-type monorail vehicle having the foregoing bogie assembly.

A traction mechanism according to an embodiment of a first aspect of the present disclosure includes: a traction component, including a transmission shaft and a traction connecting rod, the transmission shaft being connected to the traction connecting rod, the transmission shaft being suitable to be rotatably connected to a vehicle body, and the traction connecting rod being suitable to be hinged to a bogie frame; and a traction crank, both ends of the traction crank being suitable to be respectively hinged to the bogie frame and the vehicle body.

The traction mechanism according to the embodiment of the first aspect of the present disclosure has a simple and compact structure, a transmission path of a traction force is short, and the traction mechanism is convenient to assemble and disassemble, occupies a small space, is wide in usage range, can be used for low-floor and high-floor vehicles, and is also applicable to a single-axle bogie, a double-axle bogie and a multi-axle bogie.

In addition, the traction mechanism according to the foregoing embodiment of the present disclosure may also have the following additional technical features:

In some embodiments of the present disclosure, there are at least two traction components which are spaced apart laterally, and a projection of the traction crank in a horizontal plane is located between projections of the at least two traction components in the horizontal plane.

In some embodiments of the present disclosure, each traction component further includes: a first crank, a first end of the first crank being hinged to the traction connecting rod, and a second end of the first crank being fixedly connected to the transmission shaft, wherein the first end of the first crank is an end close to the traction crank.

Optionally, there are two traction components, each traction component further includes a second crank, and a first end of the second crank is fixedly connected to the transmission shaft, wherein the first end of the second crank is close to the bogie frame, and the traction mechanism further includes: a lateral connecting rod, both ends of the lateral connecting rod being respectively hinged to second ends of the two second cranks of the two traction components.

Optionally, the first crank and the second crank are arranged perpendicularly, and the first crank is located below the second crank.

Optionally, the first end of the second crank and the second end of the first crank are respectively connected to both ends of the transmission shaft through splines.

Optionally, the lateral connecting rod is set to be adjustable in length.

Further, the lateral connecting rod includes: a lateral connecting rod thread sleeve with two internal thread segments that screw in opposite directions; and two sub-lateral connecting rods, one end of each sub-lateral connecting rod being in threaded connection with one thread segment of the lateral connecting rod thread sleeve, and the other end of each sub-lateral connecting rod including a hinging joint.

In some embodiments of the present disclosure, the traction connecting rod is set to be adjustable in length.

Optionally, the traction connecting rod includes: a traction connecting rod thread sleeve with two internal thread segments that screw in opposite directions; and two sub-traction connecting rods, one end of each sub-traction connecting rod being in threaded connection with one thread segment of the traction connecting rod thread sleeve, and the other end of each sub-traction connecting rod including a hinging joint.

In some embodiments of the present disclosure, the transmission shaft is sleeved with a transmission shaft vehicle body connecting base, suitable to be connected to the vehicle body.

Optionally, each transmission shaft is sleeved with a plurality of transmission shaft vehicle body connecting bases, spaced apart in an up-down direction.

In some embodiments of the present disclosure, the traction mechanism further includes: a crank vehicle body connecting base, suitable to be connected to the vehicle body, and hinged to the first end of the traction crank; and a crank bogie connecting base, suitable to be connected to the bogie frame, and hinged to the second end of the traction crank.

Optionally, the first end of the traction crank includes a damping bushing.

In some embodiments of the present disclosure, both the traction connecting rod and the traction crank are spherically hinged to the bogie frame.

A bogie assembly according to an embodiment of a second aspect of the present disclosure includes the traction mechanism according to any of the contents involved in the first aspect.

The bogie assembly has the same advantages as the foregoing traction mechanism with respect to the prior art, and details are not described herein again.

A straddle-type monorail vehicle according to an embodiment of a third aspect of the present disclosure includes the bogie assembly according to any of the contents involved in the second aspect.

The straddle-type monorail vehicle has the same advantages as the foregoing bogie assembly with respect to the prior art, and details are not described herein again.

BRIEF DESCRIPTION OF THE DRAWINGS

The foregoing and/or additional aspects and advantages of the present disclosure become obvious and easily understood in descriptions of the embodiments with reference to the following accompanying drawings.

Drawing reference numerals.

Figure 1:
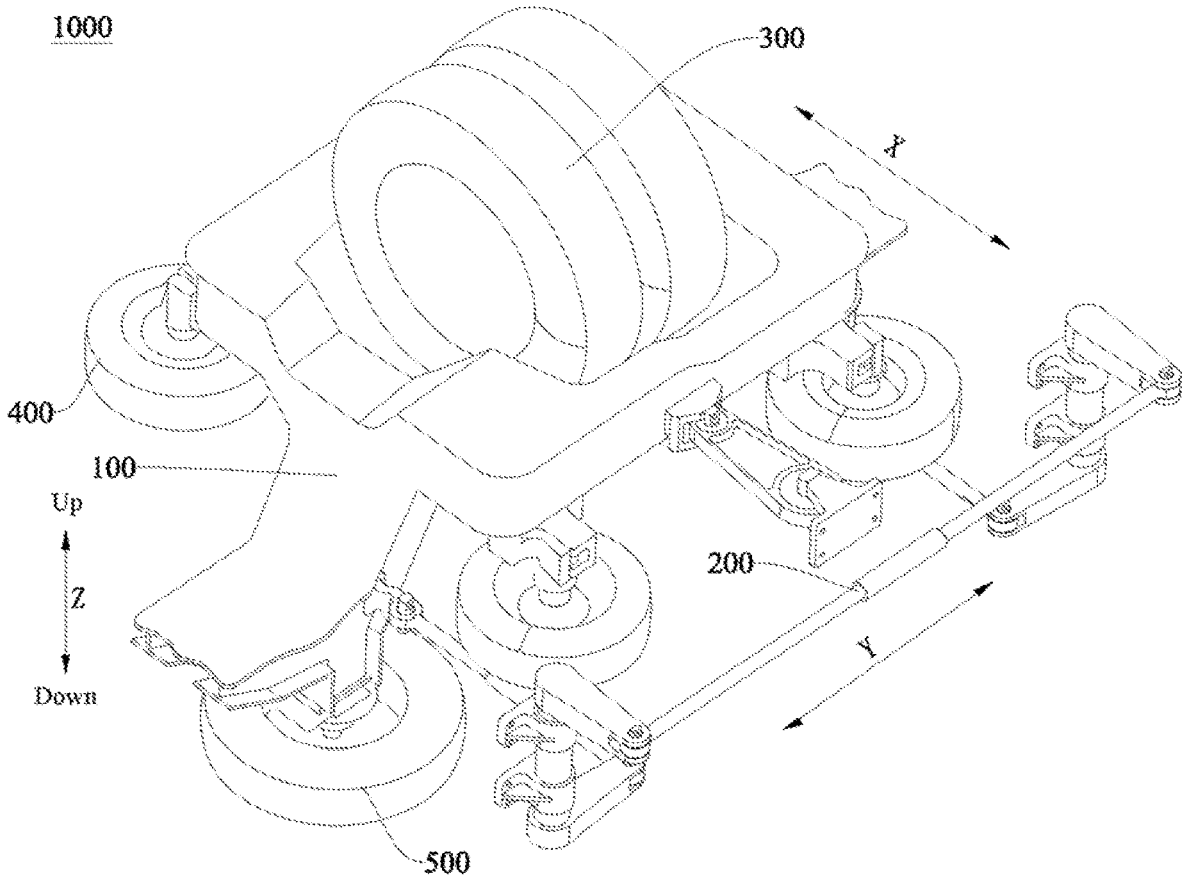
FIG. 1 is a structural schematic view of a bogie assembly according to an embodiment of the present disclosure.

bogie assembly 1000, bogie frame 100, traction mechanism 200, traction component 210, traction connecting rod 211, sub-traction connecting rod 211*a*, traction connecting rod thread sleeve 211*b*, first crank 212, transmission shaft 213, second crank 214, lateral connecting rod 215, sub-lateral connecting rod 215*a*, lateral connecting rod thread sleeve 215*b*, traction crank 220, damping bushing 221, transmission shaft vehicle body connecting base 231, crank vehicle body connecting base 232, crank bogie connecting base 233, running wheel 300, guide wheel 400, stabilizing wheel 500.

DETAILED DESCRIPTION

The following describes embodiments of the present disclosure in detail. Examples of the embodiments are shown in the accompanying drawings, where reference numerals that are the same or similar from beginning to end represent same or similar components or components that have same or similar functions. The embodiments described below with reference to the accompanying drawings are exemplary, and are used for explaining rather than limiting the present disclosure.

In the descriptions of this specification, descriptions such as reference terms "an embodiment", "some embodiments", "example", "specific example", or "some examples" intend to indicate that specific features, structures, materials, or characteristics described with reference to embodiments or examples are included in at least one embodiment or example of the present disclosure. In this specification, schematic descriptions of the foregoing terms do not need to direct at a same embodiment or example. Besides, the specific features, the structures, the materials or the characteristics that are described may be combined in a proper manner in any one or more embodiments or examples. In addition, in a case that is not mutually contradictory, persons skilled in the art can combine or group different embodiments or examples that are described in this specification and features of the different embodiments or examples.

The present disclosure is described in detail below with reference to the accompanying drawings and the embodiments.

Figure 2:
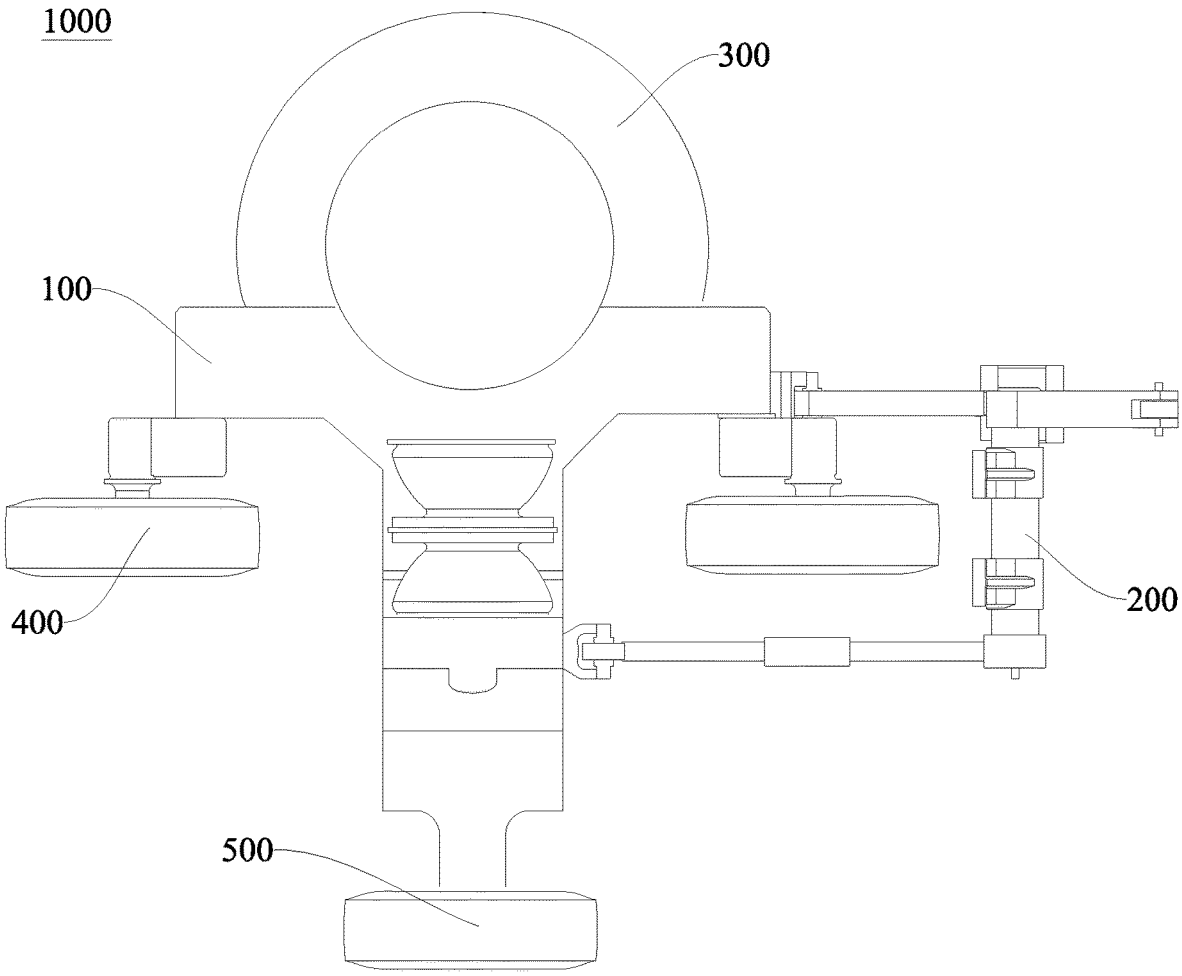
FIG. 2 is a side view of a bogie assembly according to an embodiment of the present disclosure.

A bogie assembly 1000 according to an embodiment of the present disclosure is described in detail with reference to the accompanying drawings. As shown in FIG. 1 to FIG. 2, the bogie assembly 1000 includes a bogie frame 100, a traction mechanism 200, a running wheel 300, a guide wheel 400, and a stabilizing wheel 500.

The bogie frame 100 may have a rail recess for straddling a rail beam, the running wheel 300, the guide wheel 400 and the stabilizing wheel 500 are all mounted on the bogie frame 100, and the traction mechanism 200 is connected between the bogie frame 100 and a vehicle body of a straddle-type monorail vehicle. When the running wheel 300 rotates along a rail, power for driving the straddle-type monorail vehicle to move is transmitted to the bogie frame 100, and the bogie frame 100 transmits a traction force to the vehicle body through the traction mechanism 200.

Figure 3:
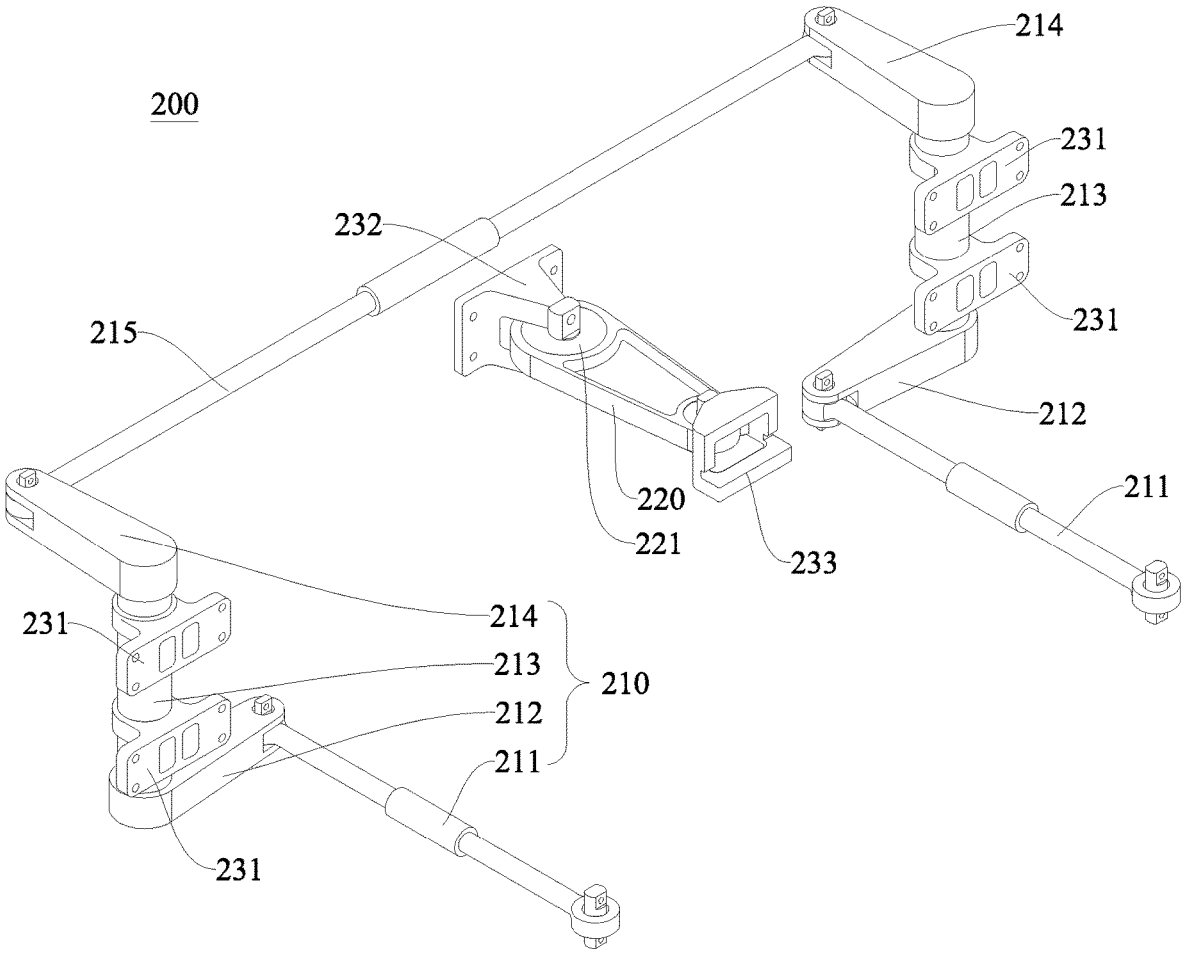
FIG. 3 is a structural schematic view of a traction mechanism according to an embodiment of the present disclosure.

The traction mechanism 200 according to an embodiment of the present disclosure is described below with reference to FIG. 1 to FIG. 5. As shown in FIG. 1 to FIG. 3, the traction mechanism 200 includes a traction component 210 and a traction crank 220.

The traction component 210 is suitable to be rotatably connected to the vehicle body, and a traction connecting rod 211 of the traction component 210 is suitable to be hinged to the bogie frame 100. Optionally, referring to FIG. 3, the traction component 210 may further include a first crank 212 and a transmission shaft 213, an end (first end) of the first crank 212 close to the traction crank 220 may be hinged to the traction connecting rod 211, and an end (second end) of the first crank 212 away from the traction crank 220 may be fixedly connected to the transmission shaft 213. For example, the second end of the first crank 212 may be connected to a lower end of the transmission shaft 213 through a spline. That is to say, the transmission shaft 213 is connected to the traction connecting rod 211. In an optional embodiment of the present disclosure, the transmission shaft 213 and the traction connecting rod 211 are rotatably connected through the first crank 212. The traction connecting rod 211 is disposed at an end of the first crank 212 close to the traction crank 220, so that a lateral (Y-direction) dimension of the traction mechanism 200 can be reduced, and interference of other components with the traction connecting rod 211 is prevented.

Figure 4:
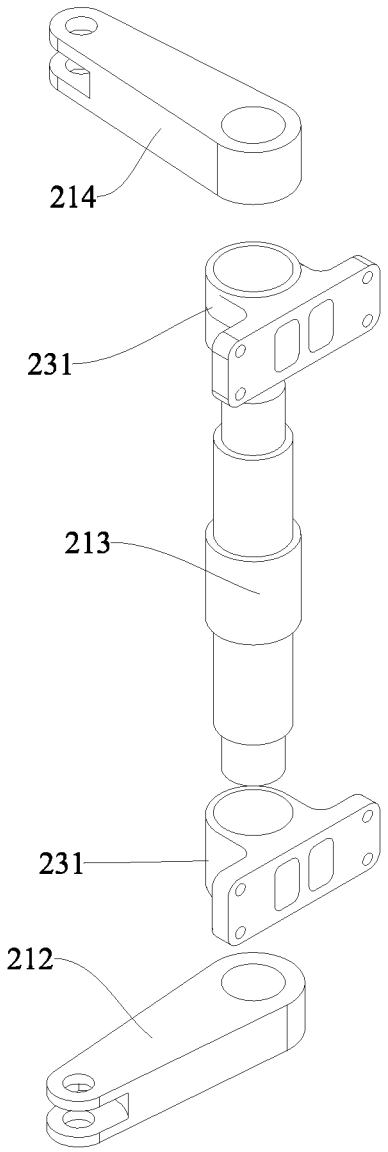
FIG. 4 is a structural schematic view of a partial structure of a traction component according to an embodiment of the present disclosure.

The transmission shaft 213 is suitable to be rotatably connected to the vehicle body. For example, the transmission shaft 213 may be sleeved with a transmission shaft vehicle body connecting base 231, the transmission shaft vehicle body connecting base 231 being suitable to be connected to the vehicle body. Referring to FIG. 3 and FIG. 4, the transmission shaft vehicle body connecting base 231 may include a plurality of mounting holes, and the transmission shaft vehicle body connecting base 231 may be connected to the vehicle body through a threaded fastener passing through the mounting hole. Each transmission shaft 213 may be sleeved with a plurality of transmission shaft vehicle body connecting bases 231 spaced apart in an up-down direction (Z direction). For example, each transmission shaft 213 in FIG. 3 and FIG. 4 may correspond to two transmission shaft vehicle body connecting bases 231.

A first end of the traction crank 220 is suitable to be hinged to the vehicle body, and a second end of the traction crank 220 is suitable to be hinged to the bogie frame 100. Referring to FIG. 3, the traction mechanism 200 may further include a crank vehicle body connecting base 232 and a crank bogie connecting base 233, the crank vehicle body connecting base 232 is suitable to be connected to the vehicle body, and the crank bogie connecting base 233 is suitable to be connected to the bogie frame 100. The crank vehicle body connecting base 232 may be fixedly connected to the vehicle body through a threaded fastener, and the crank bogie connecting base 233 may be fixedly connected to the bogie frame 100 through a threaded fastener. For example, the crank bogie connecting base 233 may be welded to the bogie frame 100. The crank vehicle body connecting base 232 may be hinged to the first end of the traction crank 220, the crank bogie connecting base 233 may be hinged to the second end of the traction crank 220, and the first end of the traction crank 220 may include a damping bushing 221. In this way, the vibration shock of an X direction (an extending direction of the rail beam) can be buffered, and the ride comfort can be improved. The damping bushing 221 may be a rubber sleeve or a nylon sleeve.

Preferably, both the traction connecting rod 211 and the traction crank 220 are spherically hinged to the bogie frame 100. In this way, when the load on the vehicle body changes, the vehicle body may be relatively raised or lowered. For example, when there are many passengers in the vehicle body, the traction connecting rod 211 may rotate downward around a spherical hinging joint between the traction connecting rod 211 and the bogie frame 100, and the traction crank 220 may rotate downward around a spherical hinging joint between the traction crank 220 and the bogie frame 100, so that the entire vehicle body is settled downward, and the center of gravity is lowered.

The traction force transmission path of the traction mechanism 200 according to the embodiment of the present disclosure is: a portion of a traction force is transmitted through the traction component 210, where the traction force is transmitted from the bogie frame 100 to the traction connecting rod 211, then transmitted to the transmission shaft 213 through the first crank 212, and finally transmitted to the vehicle body through the transmission shaft vehicle body connecting base 231; another portion of the traction force is transmitted through the traction crank 220, where the traction force is transmitted from the bogie frame 100 to the crank bogie connecting base 233, then transmitted to the crank vehicle body connecting base 232 through the traction crank 220, and finally transmitted to the vehicle body.

When the straddle-type monorail vehicle turns, the traction connecting rod 211 rotates relative to the bogie, the first crank 212 rotates together with the transmission shaft 213 relative to the traction connecting rod 211, the transmission shaft vehicle body connecting base 231 rotates relative to the transmission shaft 213, and the traction crank 220 rotates relative to the crank bogie connecting base 233 and the crank vehicle body connecting base 232.

The traction mechanism 200 according to the embodiment of the present disclosure has a simple and compact structure, a transmission path of a traction force is short, the traction mechanism 200 is convenient to assemble and disassemble and occupies a small space, and the traction mechanism 200 is wide in usage range, can be used for low-floor and high-floor vehicles, and is also applicable to a single-axle bogie, a double-axle bogie and a multi-axle bogie.

A bogie assembly 1000 according to an embodiment of the present disclosure includes the traction mechanism 200 in the foregoing structural form, so that the bogie assembly 1000 has a simple and compact structure, is convenient to assemble and disassemble, and is efficient in power transmission.

The traction mechanism 200 according to some embodiments of the present disclosure is described below.

In some embodiments of the present disclosure, there are at least two traction components 210. Referring to FIG. 1 and FIG. 3, two traction components 210 may be spaced apart in a lateral direction (Y direction), and a projection of the traction crank 220 in a horizontal plane may be located between projections of the two traction components 210 in the horizontal plane. Optionally, the traction crank 220 is equally spaced apart from the two traction connecting rods 211, the two traction connecting rods 211 have an equal height in an up-down direction, and the traction crank 220 may be located above the two traction connecting rods 211.

Thus, the traction mechanism 200 according to the embodiment of the present disclosure forms a three-connecting rod mechanism, and the traction crank 220 and the two traction connecting rods 211 form a stable three-point traction. The traction stability is strong, so that the traction mechanism 200 has sufficient anti-roll capability.

In some embodiments of the present disclosure, the traction mechanism 200 may further include a lateral connecting rod 215, and there are at least two traction components 210. Referring to FIG. 1 and FIG. 3, each traction component 210 includes a traction connecting rod 211, a first crank 212, a transmission shaft 213, and a second crank 214. According to an optional embodiment of the present disclosure, the first crank 212 is located below the second crank 214. A first end of the traction connecting rod 211 is hinged to the bogie frame 100, a second end of the traction connecting rod 211 is hinged to a first end of the first crank 212, a second end of the first crank 212 may be fixedly connected to a lower end of the transmission shaft 213, the transmission shaft 213 is rotatably connected to the vehicle body, an upper end of the transmission shaft 213 may be fixedly connected to an end (first end) of the second crank 214 close to the bogie frame, and both ends of the lateral connecting rod 215 are respectively hinged to ends (second ends) of the two second cranks 214 away from the bogie frame 100. Thus, the distance between the lateral connecting rod 215 and the bogie frame 100 is relatively large, facilitating the assembly of the traction mechanism 200.

The second crank 214, the transmission shaft 213 and the first crank 212 do not rotate relative to each other. For example, the second crank 214 is connected to the upper end of the transmission shaft 213 through a spline, and the first crank 212 is connected to the lower end of the transmission shaft 213 through a spline. Throughout the operation of the traction mechanism 200, the axis of the second crank 214 and the axis of the first crank 212 remain unchanged. Optionally, the second crank 214 and the first crank 212 are arranged perpendicularly. In other words, the length direction of the second crank 214 is perpendicular to the length direction of the first crank 212, so that the arm of force of the traction component 210 is longer, and the force transmission is efficient. Of course, other manners such as a form of key grooves may be adopted to fixedly connect the first crank 212 and the transmission shaft 213 as well as the second crank 214 and the transmission shaft 213.

It is understandable that when turning, the interaction of the lateral connecting rod 215 and the two traction components 210 can ensure that the two traction connecting rods 211 are deflected in the same direction, so that the vehicle body can smoothly pass through a small curve. Further, when the straddle-type monorail vehicle enters a curve, clamping forces of guide wheels 400 on both sides of the rail beam are different, and the traction component 210 on the side where the clamping force is relatively large may transmit the force to the traction component 210 on the other side through the lateral connecting rod 215, thereby balancing the clamping forces of the guide wheels 400 on both sides.

In the case of emergency braking or rapid acceleration, the bogie frame 100 has a tendency to skew forward or backward about a wheel axle due to inertia, and the traction mechanism 200 formed by the lateral connecting rod 215, the traction component 210 and the traction crank 220 can effectively constrain the pitch motion of the bogie frame 100.

That is to say, the traction mechanism 200 according to the embodiment of the present disclosure has a function of assisting steering and suppressing the pitch motion of the bogie frame 100.

Figure 5:
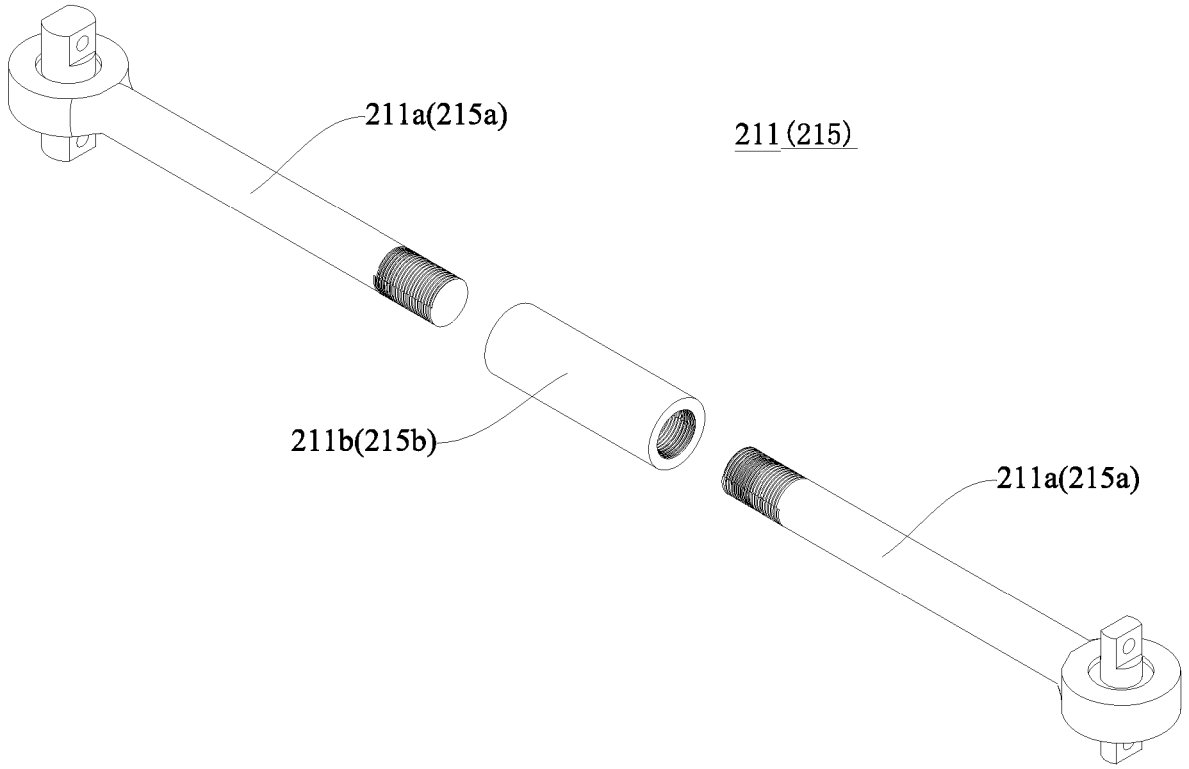
FIG. 5 is a structural schematic view of a traction connecting rod and a lateral connecting rod according to an embodiment of the present disclosure.

In some embodiments of the present disclosure, referring to FIG. 5, the traction connecting rod 211 may be set to be adjustable in length. Optionally, the traction connecting rod 211 may include a traction connecting rod thread sleeve 211*b* and two sub-traction connecting rods 211*a*. The traction connecting rod thread sleeve 211*b* may include two internal thread segments that screw in opposite directions, one end of each sub-traction connecting rod 211*a* is in threaded connection with one thread segment of the traction connecting rod thread sleeve 211*b*, and the traction connecting rod 211 can be conveniently extended and/or retracted by rotating the traction connecting rod thread sleeve 211*b*. The other end of each sub-traction connecting rod 211*a* includes a hinging joint. The hinging joint of one of the sub-traction connecting rods 211*a* is used for hinging to the bogie frame 100, where the hinging joint may be a universal spherical hinge. The hinging joint of the other sub-traction connecting rod 211*a* is used for hinging to the first crank 212.

In some embodiments of the present disclosure, referring to FIG. 5, the lateral connecting rod 215 may be set to be adjustable in length. Optionally, the lateral connecting rod 215 may include a lateral connecting rod thread sleeve 215*b* and two sub-lateral connecting rods 215*a*. The lateral connecting rod thread sleeve 215*b* may include two internal thread segments that screw in opposite directions, one end of each sub-lateral connecting rod 215*a* is in threaded connection with one thread segment of the lateral connecting rod thread sleeve 215*b*, and the lateral connecting rod 215 can be conveniently extended and/or retracted by rotating the lateral connecting rod thread sleeve 215*b*. The other end of each sub-lateral connecting rod 215*a* includes a hinging joint. The two hinging joints of the two sub-lateral connecting rods 215*a* are respectively hinged to the two second cranks 214.

The present disclosure also discloses a straddle-type monorail vehicle. The straddle-type monorail vehicle according to the embodiment of the present disclosure includes any bogie assembly 1000 described in the foregoing embodiment, which makes the straddle-type monorail vehicle efficient in power transmission and more convenient to assemble and disassemble.

In descriptions of the present disclosure, it should be understood that direction or position relationships indicated by terms such as "horizontal", "length", "width", "thickness", "above", "below", "front", "back", "left", "right", "vertical", "horizontal", and "axial" are direction or position relationships based on the accompanying drawings, and are used only for conveniently describing the present disclosure and simplifying descriptions, instead of indicating or suggesting that a represented apparatus or component needs to have a particular direction or is constructed and operated in a particular direction, and therefore shall not be understood as limiting the present disclosure.

In the present disclosure, it should be noted that unless otherwise clearly specified and limited, the terms "mounted", "connected", "connection", and "fixed" should be understood in a broad sense. For example, a connection may be a fixed connection, a detachable connection, or an integral connection; may be a mechanical connection or an electrical connection; may be a direct connection or an indirect connection by means of an intermediate medium; or may be internal communication between two elements or interaction relationship between two elements, unless otherwise clearly limited. A person of ordinary skill in the art may understand specific meanings of the foregoing terms in the present disclosure according to a specific situation.

Although the embodiments of the present disclosure are shown and described above, it may be understood that the foregoing embodiments are examples, and cannot be understood as limitations to the present disclosure. A person of ordinary skill in the art may make changes, modifications, replacements, and variations to the foregoing embodiments without departing from the scope of the present disclosure.

What is claimed is:

1. A traction mechanism, comprising:

a traction component, comprising a transmission shaft and a traction connecting rod, the transmission shaft being connected to the traction connecting rod and rotatably connected to a vehicle body, and the traction connecting rod being hinged to a bogie frame; and a traction crank, ends of the traction crank being respectively hinged to the bogie frame and the vehicle body, wherein the traction connecting rod and the traction crank are spherically hinged to the bogie frame.

2. The traction mechanism according to claim 1, wherein the traction mechanism comprises at least two traction components spaced apart laterally, and a projection of the traction crank in a horizontal plane is located between projections of the at least two traction components in the horizontal plane.

3. The traction mechanism according to claim 1, wherein the traction component further comprises: a first crank, wherein a first end of the first crank is hinged to the traction connecting rod, a second end of the first crank is fixedly connected to the transmission shaft, and the first end of the first crank is close to the traction crank.

4. The traction mechanism according to claim 3, wherein the traction mechanism comprises:

two traction components, wherein each traction component further comprises a second crank, a first end of the second crank is fixedly connected to the transmission shaft, and the first end of the second crank is close to the bogie frame; and a lateral connecting rod, wherein ends of the lateral connecting rod are respectively hinged to second ends of the two second cranks of the two traction components.

5. The traction mechanism according to claim 4, wherein the first crank and the second crank are arranged perpendicularly, and the first crank is located below the second crank.

6. The traction mechanism according to claim 4, wherein the first end of the second crank and the second end of the first crank are respectively connected to ends of the transmission shaft through splines.

7. The traction mechanism according to claim 4, wherein the lateral connecting rod is adjustable in length.

8. The traction mechanism according to claim 7, wherein the lateral connecting rod comprises:

a lateral connecting rod thread sleeve having two internal thread segments respectively at ends of the lateral connecting rod thread sleeve; and two sub-lateral connecting rods, wherein one end of each sub-lateral connecting rod is in threaded connection with one of the two internal thread segments of the lateral connecting rod thread sleeve, and the other end of each sub-lateral connecting rod includes a hinging joint.

9. The traction mechanism according to claim 1, wherein the traction connecting rod is adjustable in length.

10. The traction mechanism according to claim 9, wherein the traction connecting rod comprises:

a traction connecting rod thread sleeve having two internal thread segments respectively at ends of the traction connecting rod thread sleeve; and two sub-traction connecting rods, wherein one end of each sub-traction connecting rod is in threaded connection with one of the two internal thread segments of the traction connecting rod thread sleeve, and the other end of each sub-traction connecting rod includes a hinging joint.

11. The traction mechanism according to claim 1, wherein the transmission shaft is sleeved with a transmission shaft vehicle body connecting base configured to be connected to the vehicle body.

12. The traction mechanism according to claim 11, wherein the transmission shaft is sleeved with a plurality of transmission shaft vehicle body connecting bases, spaced apart in an up-down direction.

13. The traction mechanism according to claim 1, further comprising:

a crank vehicle body connecting base connected to the vehicle body, and hinged to the first end of the traction crank; and a crank bogie connecting base connected to the bogie frame, and hinged to the second end of the traction crank.

14. The traction mechanism according to claim 13, wherein the first end of the traction crank includes a damping bushing.

15. A bogie assembly, comprising a traction mechanism, wherein the traction mechanism comprises:

a traction component, comprising a transmission shaft and a traction connecting rod, the transmission shaft being connected to the traction connecting rod and rotatably connected to a vehicle body, and the traction connecting rod being hinged to a bogie frame;

a traction crank, ends of the traction crank being respectively hinged to the bogie frame and the vehicle body, wherein the traction connecting rod and the traction crank are spherically hinged to the bogie frame.

16. A straddle-type monorail vehicle, comprising a bogie assembly comprising a traction mechanism, wherein the traction mechanism comprises:

a traction component, comprising a transmission shaft and a traction connecting rod, the transmission shaft being connected to the traction connecting rod and rotatably connected to a vehicle body, and the traction connecting rod being hinged to a bogie frame; and a traction crank, ends of the traction crank being respectively hinged to the bogie frame and the vehicle body, wherein the traction connecting rod and the traction crank are spherically hinged to the bogie frame.

* * * * *